United States Patent [19]

Nishiyama et al.

[11] Patent Number: 5,065,720

[45] Date of Patent: Nov. 19, 1991

[54] ENGINE WITH MECHANICAL GOVERNOR AND DECOMPRESSION DEVICE

[75] Inventors: Shigeru Nishiyama; Hideazu Amano, both of Sakai, Japan

[73] Assignee: Kubota Corporation, Osaka, Japan

[21] Appl. No.: 599,409

[22] Filed: Oct. 18, 1990

[30] Foreign Application Priority Data

Nov. 2, 1989 [JP] Japan ..... 1-286517

[51] Int. Cl.[5] ..... F01L 13/08; F02D 31/00

[52] U.S. Cl. ..... 123/363; 123/182; 123/90.31; 123/90.6

[58] Field of Search ..... 123/182, 363, 90.6, 123/90.31

[56] References Cited

U.S. PATENT DOCUMENTS

| | | | |
|---|---|---|---|
| 757,269 | 4/1904 | Casteel | 123/363 |
| 1,108,198 | 8/1914 | Link | 123/363 |
| 4,380,216 | 4/1983 | Kandler | 123/90.6 |
| 4,610,227 | 9/1986 | Nakano et al. | 123/182 |
| 4,697,557 | 10/1987 | Tamba et al. | 123/363 |
| 4,977,793 | 12/1990 | Husted | 123/90.6 |

FOREIGN PATENT DOCUMENTS

| | | | |
|---|---|---|---|
| 53-20593 | 5/1978 | Japan | 123/182 |

*Primary Examiner*—Andrew M. Dolinar
*Attorney, Agent, or Firm*—Bacon & Thomas

[57] ABSTRACT

In an engine with a mechanical governor and decompression device, a centrifugal weight of a decompression device is supported by a first side surface, which first side surface faces a valve actuating cam, of opposite side surfaces of valve swingable manner in the centrifugal direction. A governor weight of a mechanical governor is supported by the second side surface of the opposite side surface of the cam gear. A member for transmitting a centrifugal force of the governor weight is supported by a valve actuating camshaft outside the second side surface of the valve actuating cam gear.

9 Claims, 2 Drawing Sheets

ENGINE WITH MECHANICAL GOVERNOR AND DECOMPRESSION DEVICE

BACKGROUND OF THE INVENTION

1. Field of the Invention

The present invention relates to an internal combustion engine, and more specifically to an engine equipped with a mechanical governor for holding an engine revolution speed at a predetermined value though an engine load varies as well as a decompression device for decreasing a starting torque at the time of starting operation of the engine.

2. Description of the Related Arts

As such an engine known by the inventors of the present invention, there has been provided the one having the following construction.

That is, a valve actuating camshaft and a governor shaft are arranged in parallel with a crankshaft. The valve actuating camshaft is interlockingly connected to the crankshaft through a valve actuating cam gear, and the governor shaft is interlockingly connected to the crankshaft through a governor gear. A centrifugal weight of the decompression device is supported by one of the opposite side surfaces of the valve actuating cam gear so as to be swingable in the centrifugal direction [for example, refer to U.S. Pat. No. 4,610,227 (Nakano et al.) allowed to the assignee of the present invention]. A governor weight of a mechanical governor is supported by the governor shaft.

In the above-mentioned prior art, when the mechanical governor and the decompression device are installed to the engine, it is necessary to arrange two shafts of the governor shaft and the valve actuating camshaft. Therefore, the engine can't help becoming large in overall dimension.

On one hand, in the case that the engine is intended to be made smaller in overall dimension in the above-mentioned construction of the prior art, it is necessary to make both the centrifugal weight of the decompression device and the governor weight smaller in size in order to avoid an interference therebetween. Thereupon, the decompression device provides a small centrifugal force for cancellation of the decompression and the decompression capability thereof can't help becoming small correspondingly. Also the mechanical governor provides a small governor force and the governor capability thereof is lowered.

SUMMARY OF THE INVENTION

It is an object of the present invention to make an overall compactness of an engine compatible with the securement of a decompression capability and a governor capability.

For accomplishing the above-mentioned object, the present invention is constructed as follows.

A centrifugal weight of a decompression device is supported by a first side surface, which first side surface faces a valve actuating cam, of opposite side surfaces of a valve actuating cam gear in a swingable manner in the centrifugal direction. A governor weight of a mechanical governor is supported by a second side surface, which second side surface is opposed to the first side surface, of the opposite side surfaces of the gear. A centrifugal force transmission member of the governor weight is supported by a valve actuating camshaft outside the second side surface of the valve actuating cam gear.

Since the present invention is constructed as mentioned above, the following advantages can be provided.

Since, in addition to the centrifugal weight of the decompression device, also the governor weight of the mechanical governor is supported by the valve actuating cam gear, the governor shaft and the governor gear employed in the conventional construction can be omitted. Therefore, the engine can be made small, and the construction thereof can be simplified.

Further, since the centrifugal weight and the governor weight are disposed on the opposite sides of the cam gear respectively, an interference between both swinging orbits thereof can be prevented. Therefore, both the weights can be made large in size. Accordingly, since the decompression device can be equipped with a strong decompression spring by enlarging the decompression cancellation centrifugal force of the centrifugal weight in that way, a sufficient decompression capability can be surely provided. At the same time, since the mechanical governor can exert a strong governor force by enlarging the centrifugal force of the governor weight in that way, the governor capability can be kept in a good condition.

Resultantly, it becomes possible to make the compaction of the engine in overall dimension compatible with the securement of the decompression capability and governor capability.

BRIEF DESCRIPTION OF THE DRAWINGS

The above and other important features of the present invention will be better understood from the following detailed description of preferred embodiments of the invention, made with reference to the accompanying drawings, in which:

FIG. 1 is a vertical sectional front view of a vertical-shaft type engine;

FIG. 2 is an enlarged view of a valve actuating camshaft portion in FIG. 1 and a partial sectional view showing a decompression condition;

FIG. 3 is a sectional view taken along the III—III directed line in FIG. 2;

FIG. 4 is a sectional view taken along the IV—IV directed line in FIG. 2.

DESCRIPTION OF THE PREFERRED EMBODIMENTS

Figure 1:
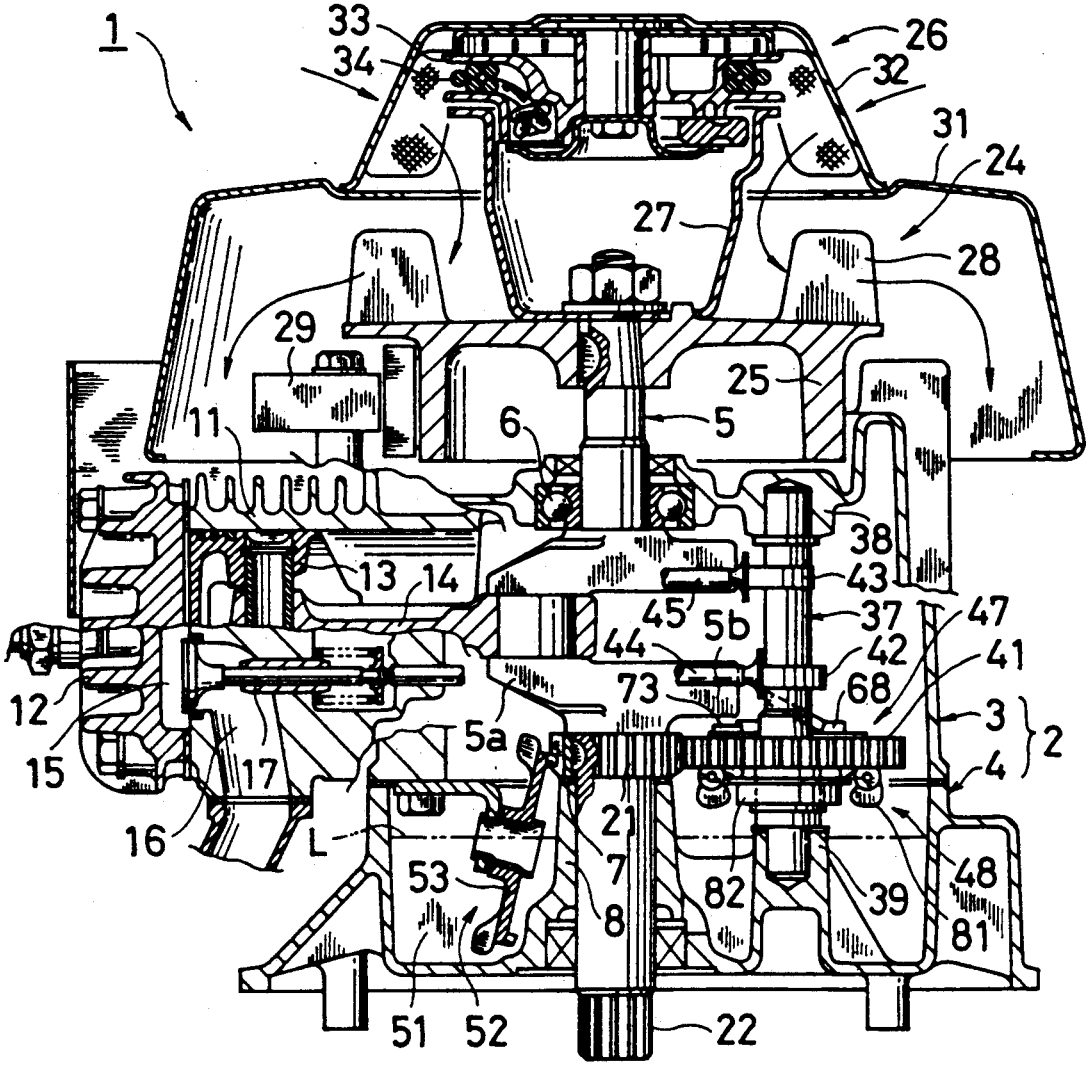

Firstly, an overall construction of an engine will be explained with reference to FIG. 1.

This engine 1 is a vertical-shaft type air-cooled small gasoline engine with a single cylinder, of the side valve type and having a piston displacement of ab. 90 cc.

An engine body 2 is provided with an upper crankcase 3 and a lower crankcase 4. A vertical crankshaft 5 is rotatably supported by the upper and the lower crankcases 3, 4 through an upper radial bearing 6, a lower thrust bearing 7 and a supporting tube 8. A cylinder portion 11 is horizontally protruded from the upper crankcase 3, and a cylinder head 12 is fixedly secured to the leading end surface of the cylinder portion 11. A piston 13 accommodated within the cylinder portion 11 is connected to a crank arm 5*a* of the crankshaft 5 through a connecting rod 14, and a combustion chamber 15 is formed between the piston 13 and the cylinder head 12. An intake port 16 and an exhaust port (not illustrated) are opened in the cylinder portion 11 so as to face the combustion chamber 15. An intake valve 17 and an exhaust valve (not illustrated) are horizontally installed to the intake port 16 and to the exhaust port respectively.

A crank gear 21 is fixedly secured to the lower portion of the crankshaft 5, and an output portion 22 is formed in the lower end thereof. On one hand, a rotor 25 of a centrifugal cooling fan 24 and a pulley 27 of a recoil starter 26 are fixedly secured to the upper end of the crankshaft 5 in order from below. A plurality of vanes 28 are projected from the upper surface of the rotor 25. An ignition coil 29 is disposed around the rotor 25 so as to face the external surrounding surface of the rotor 25. A recoil case 32 is fixedly secured to the upper surface of a fan case 31 which covers the rotor 25 and the pulley 27, and a reel 33 is rotatably accommodated within the recoil case 32. A start rope 34 is wound around the reel 33, and a starting grip (not illustrated) is attached to the leading end of the start rope 34. On the other hand, as shown by the arrows in the figure, a cooling air is sucked from the external circumferential surface of the recoil case 32 and discharged downward from the fan case 31.

A valve actuating camshaft 37 is arranged in parallel with the crankshaft 5 and rotatably supported at an upper boss 38 and a lower boss 39 by the upper and the lower crankcases 3, 4 respectively. A valve actuating cam gear 41, an intake valve actuating cam 42 and an exhaust valve actuating cam 43 are arranged onto the valve actuating camshaft 37 in order from below. The valve actuating cam gear 41 is disposed below the crank arm 5*a* and balance weights 5*b* of the crankshaft 5 and intermeshed with a crank gear 21. The cams 42, 43 are interlockingly connected to the intake valve 17 and the exhaust valve through valve lifters 44, 45 respectively.

A centrifugal decompression device 47 is disposed between the valve actuating cam gear 41 and the intake valve actuating cam 42, and a mechanical governor 48 is disposed between the gear 41 and the lower boss 39. Then, an oil splashing device 52 is disposed in a lubricating oil storage chamber 51 within the lower crankcase 4. A rotor 53 of the oil splashing device 52 is intermeshed with the crank gear 21. The symbol L designates a level of a lubricating oil.

Then, the constructions of the valve actuating camshaft 37, the valve actuating cam gear 41, the decompression device 47 and the mechanical governor 48 will be explained in detail with reference to FIGS. 2 through 4.

The valve actuating camshaft 37 comprises an inner shaft portion 55 made of a carbon steel and an outer tubular portion 56 made of a glass fiber reinforced plastic and fixedly secured to the external circumference of the inner shaft portion 55. The valve actuating cam gear 41 has a boss 58, a rim 59 and an arm 60, and is made of a glass fiber reinforced plastic so as to be integratedly formed in one piece with the outer tubular portion 56. Both the cams 42, 43 are made from a sintered alloy metal and are externally fitted to the inner shaft portion 55 so as to be fixedly secured thereto. The outer tubular portion 56 and the valve actuating cam gear 41 are integratedly formed in one piece by means of an injection molding relative to the inner shaft portion 55 under the cam fixed condition. Incidentally, key grooves 62 and communication grooves 63 are formed in the inner shaft portion 55 at the positions corresponding to the respective cams 42, 43 opposite to each other. Key portions 64 of the cams 42, 43 are fitted into the key grooves 62. The communication grooves 63 are used as a flow passage allowing a melt resin to flow in the axial direction at the time of injection molding.

Figure 3:
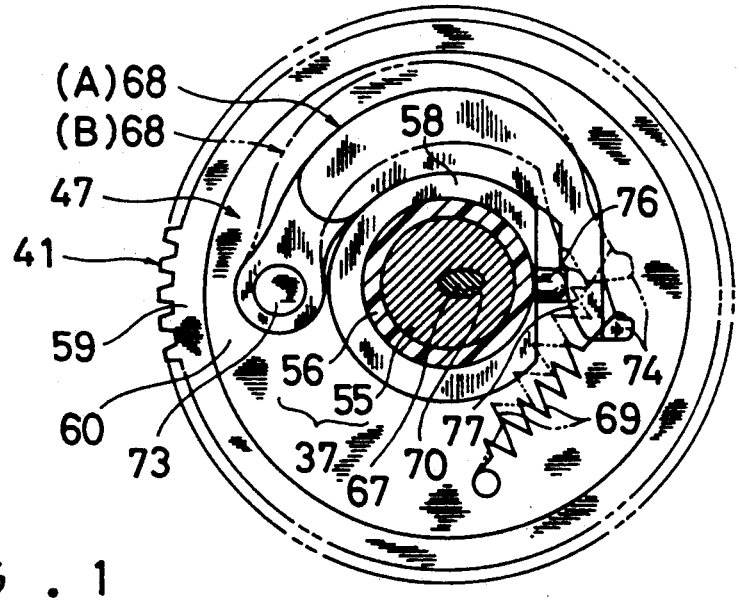
FIGS. 1 through 4 show one embodiment of the present invention.
Figure 4:
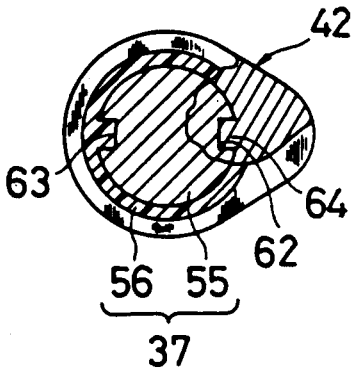

The decompression device 47 is provided with a decompression pin 67, a centrifugal weight 68 and a decompression spring 69 (refer to FIG. 3). A pin guide through-hole 70 for the decompression pin 67 is slantly formed in the valve actuating camshaft 37 so that the decompression pin 67 can reciprocate through the pin guide through-hole 70. In order to install the decompression pin 67 into the through-hole 70, a pin insertion through-hole 71 is slantly formed in the arm 60 of the valve actuating cam gear 41. The centrifugal weight 68 is composed of two sheets of C-shaped steel plates connected to each other. This C-shaped centrifugal weight 68 is put in an annular groove between the boss 58 and the rim 59 of the cam gear 41 from above and supported by an upper side surface (a first side surface) F of the arm 60 through a pivot pin 73 so as to be swingable in the centrifugal direction while it is resiliently urged in the centripetal direction by the decompression spring 69 connected to a weight swinging end 74. These centrifugal weight 68 and pivot pin 73 are disposed below the crank arm 5*a* and the balance weight 5*b* of crankshaft 5 (refer to FIG. 1). The decompression pin 67 is kept at its lower end large diameter input portion 76 in contact with a weight output portion 77 of the centrifugal weight 68 and kept at its upper end small diameter output portion 78 in contact with the valve lifter 44.

The decompression device 47 operates as follows.

Since revolution speeds of the crankshaft 5 and the valve actuating camshaft 37 are low at the initial stage of the starting of the engine 1 by the recoil starter 26, the centrifugal weight 68 is resiliently urged in the centripetal direction by the decompression spring 69 so as to be received by the external circumferential surface of the boss 58 of the cam gear 41 and to be changed over to the decompression position A (refer to the position indicated by the solid line in FIG. 3). Thereby, the small diameter output portion 78 of the decompression pin 67 pushes the valve lifter 44 so as to hold the intake valve 17 in the valve opened condition. As a result, the combustion chamber 15 is communicated to the outside air, so that the engine 1 can be readily started by an operator with a small force.

After the starting operation, when the revolution speed of the crankshaft 5 is increased and the revolution speed of the valve actuating camshaft 37 reaches a predetermined value, a strong centrifugal force acts on the centrifugal weight 68. The centrifugal weight 68 is swung in the centrifugal direction by its own centrifugal force against the spring 69 so as to be received by the inner circumferential surface of the rim 59 of the cam gear 41 and to be changed over to the decompression cancellation position B (refer to the position indicated by the alternate long and short dash line in FIG. 3). Accompanied therewith, the decompression pin 67 is moved slantly downward by the centrifugal force acting on the large diameter input portion 76. Thereby, the decompression actuation of the decompression pin 67 is cancelled, so that the engine 1 can start.

Incidentally, when the engine 1 is operated for stopping, the centrifugal weight 68 is resiliently urged in the centripetal direction by the spring 69 so that the decompression pin 67 pushes the valve lifter 44 to hold the intake valve 17 in the valve opened condition.

The mechanical governor 48 is provided with four governor weights 81, a governor sleeve 82 as a member for transmitting the centrifugal force of the weights 81, a governor lever and a governor spring (the latter two are not illustrated). An annular weight holder 85 is externally fitted to the boss 58 of the cam gear 41 from below and is fixedly secured to a lower surface S (a second side surface) of the arm 60 by the weight pivot pin 73. Those four governor weights 81 are supported by four weight supporting portions 86 projecting downward from the weight holder 85 so as to be swingable in the centrifugal direction. A sleeve guide tube 88 made of a steel is externally fitted to the outer tubular portion 56 of the camshaft 37 on the lower side of the cam gear 41. The outer tubular portion 56 and the guide tube 88 are supported by the lower boss 39 through a thrust bearing 89. The governor sleeve 82 is externally fitted to the guide tube 88 so as to be reciprocatingly movable in the axial direction. The centrifugal force of the governor weights 81 is adapted to be transmitted to the governor lever through the governor sleeve 82. By a balance between the centrifugal force of the governor weights 81 and the resilient force of the governor spring, a fuel quantity regulating means (not illustrated) connected to the governor lever is operatively controlled.

Figure 2:
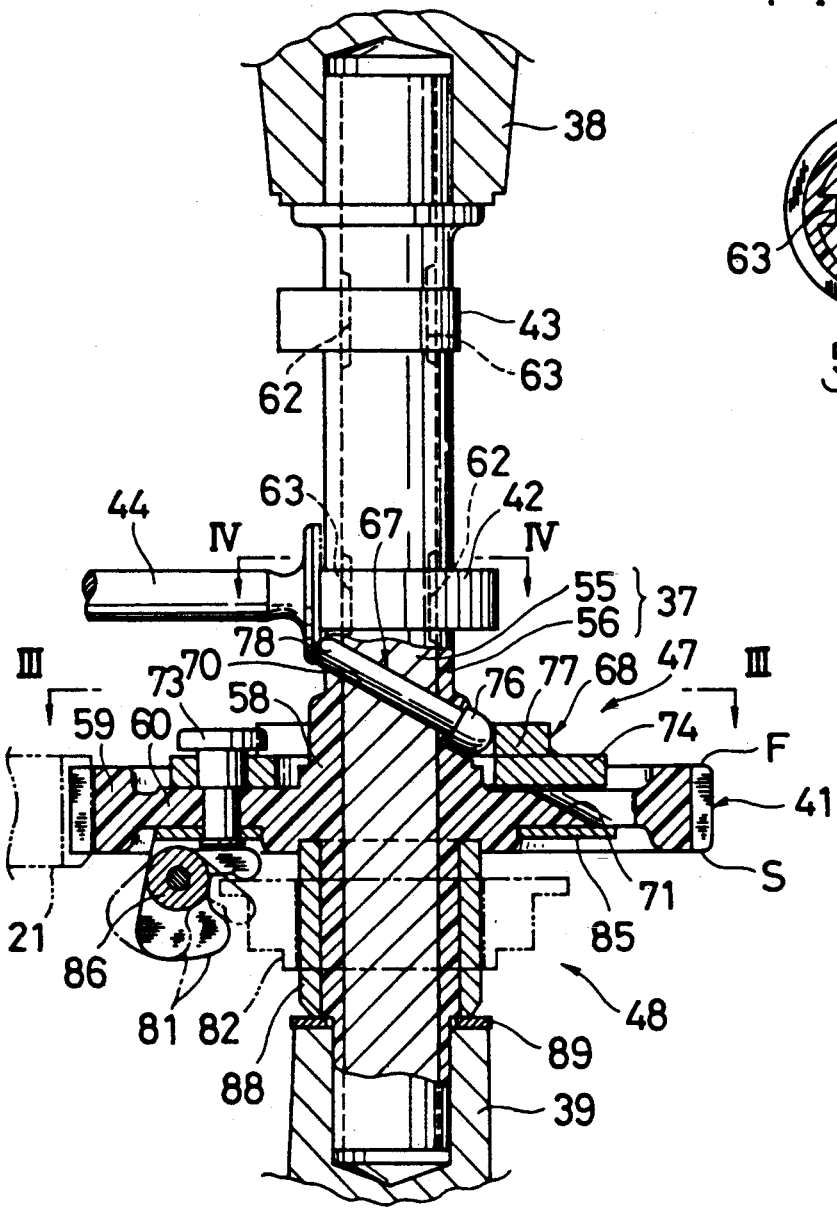

That is, when the revolution speed of the engine is increased by a decrease of a load during the running of the engine, the governor weights 81 swing in the centrifugal direction (refer to the position indicated by the alternate long and short dash line in FIG. 2) so as to move the governor sleeve 82 downward against the resilient force of the governor spring. Thereby, the governor lever actuates the fuel quantity regulating means to a fuel decrease side, so that the engine revolution speed can be maintained at a predetermined speed. To the contrary, when the engine revolution speed is decreased by an increase of the load, the governor weights 81 swing in the centripetal direction (refer to the position indicated by the solid line in FIG. 2) so as to move the governor sleeve 82 upward by the resilient force of the governor spring. Thereby, the governor lever actuates the fuel quantity regulating means to a fuel increase side, so that the engine revolution speed can be maintained at a predetermined speed.

According to the above-mentioned embodiment, the following advantages can be provided.

Since the centrifugal weight 68 of the decompression device 47 is supported by the upper side surface F as the first side surface of the valve actuating cam gear 41 and the governor weights 81 of the mechanical governor 48 is supported by the lower side surface S as the second side surface of the cam gear 41, the governor shaft and the governor gear can be omitted. Therefore, the engine body 2 can be made small in size and simplified in construction. In addition, since the centrifugal weight 68 and the governor weights 81 can be disposed on the opposite sides of the cam gear 41, the interference between both the swing orbits thereof can be prevented. Therefore, it becomes possible to make both the weights 68, 81 large in size. Since the decompression device 47 can be provided with a strong decompression spring 69 by enlarging the decompression cancellation centrifugal force of the centrifugal weight 68, the sufficient decompression capability can be surely provided. Further, since the mechanical governor 48 can have a strong governor force by enlarging the centrifugal force of the governor weights 81, the governor capability can be maintained in a good condition.

Since the centrifugal weight 68 of the decompression device 47 is installed in the annular groove formed between the boss 58 and the rim 59 of the valve actuating cam gear 41, the axial length of the valve actuating camshaft 37 can be shortened. Thereby, the engine body 2 can be further made smaller in size.

Since the member for transmitting the centrifugal force of the governor weights 81 is formed as the sleeve 82 so as to be externally fitted to the valve actuating camshaft 37, the mechanical governor 48 can be made compact. Correspondingly to that compactness, the engine body 2 can be made smaller in size.

Since the valve actuating cam gear 41 and the centrifugal weight 68 of the decompression device 47 are arranged below the crank arm **5*a* and the balance weight 5*b* of the crankshaft 5, a distance between the crankshaft 5 and the valve actuating camshaft 37 can be shortened. Also owing to that shortening, the engine body 2** can be made smaller in size.

Further, since the valve actuating camshaft 37 comprises the metal inner shaft portion 55 and the synthetic resin outer tubular portion 56, it can be made light in weight. Further, since the valve actuating cam gear 41 made of the synthetic resin is integratedly formed in one piece with the outer tubular portion 56, a work for positioning the gear 41 with respect to the camshaft 37 can be omitted so that an assembling work of the engine 1 becomes easier.

Figure 5:
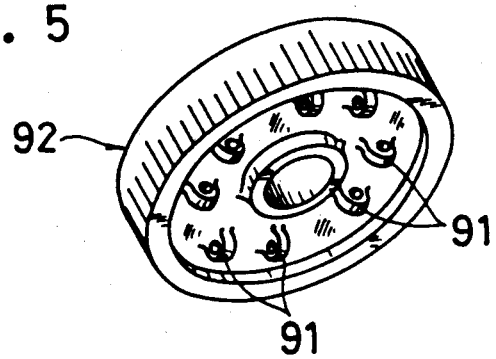
FIG. 5 shows a variant of the present invention and a perspective view of a valve actuating cam gear.

FIG. 5 shows a variant of the valve actuating cam gear.

A plurality of weight supporting portions 91 are integratedly formed in one piece with a cam gear 92 at the time of molding of the resin cam gear 92. Thereby, the weight holder can be omitted, so that the supporting construction for the governor weights can be simplified.

Incidentally, the above-mentioned embodiment can be modified like the following items (a) through (e).

(a) The engine may be a diesel engine instead of the gasoline engine, may be of the horizontal-shaft type instead of the vertical-shaft type, and may be of the liquid-cooled type or of the partial liquid-cooled type instead of the air-cooled type.

(b) The valve actuating mechanism may be of the overhead valve type instead of the side valve type.

(c) The engine starting system may be of the type using a starter motor instead of the recoil starting type.

(d) The valve actuating camshaft and the valve actuating cam gear may be separately manufactured and connected to each other through a key. Further, the valve actuating camshaft and the valve actuating cam gear may be formed from only a metal.

(e) The governor weight may be of the type utilizing a centrifugal force of a ball instead of the swing type.

It will be apparent that, although a specific embodiment and certain modifications of the invention have been described in detail, the invention is not limited to the specifically illustrated and described constructions since the variations may be made without departing from the principles of the invention.

What is claimed is:

1. An engine with a mechanical governor and a decompression device, comprising:

a valve actuating camshaft having a valve actuating cam gear and a valve actuating cam arranged side by side thereon, said valve actuating camshaft being rotatably supported by an engine body, said valve actuating cam gear being provided with a first side surface facing said valve actuating cam and a second side surface on the opposite side to said first side surface, a centrifugal decompression device provided with a centrifugal weight, means for mounting said centrifugal weight to the first side surface of said valve actuating cam gear in a swingable manner in the centrifugal direction, and a mechanical governor provided with a governor weight and a member for transmitting a centrifugal force of said governor weight, said governor weight being supported by the second side surface of said valve actuating cam gear by said mounting means, and said member for transmitting the centrifugal force being supported by said valve actuating camshaft outside the second side surface of said valve actuating cam gear.

2. An engine as defined in claim 1, wherein said valve actuating cam gear is provided with a boss, a rim and an arm and has an annular groove concaved in the first side surface of the arm between the boss and the rim, and the centrifugal weight of said decompression device is put in said annular groove and supported by the arm so as to be swingable in the centrifugal direction.

3. An engine as defined in claim 1, wherein said member for transmitting the centrifugal force of said governor weight is formed in a tubular configuration and externally fitted to the valve actuating camshaft.

4. An engine as defined in claim 2 further comprising:

a crankshaft has a crank arm and balance weights and is rotatably supported by said engine body, said valve actuating camshaft is disposed in parallel with said crankshaft, and said valve actuating cam gear and said centrifugal weight are disposed on the side of the second side surface rather than on the crank arm and the balance weight.

5. An engine as defined in claim 1, wherein said valve actuating camshaft comprises an inner shaft portion and an outer tubular portion fixedly secured to the external circumference of said inner shaft portion, and said inner shaft portion is made of a metal and said outer tubular portion is made of a fiber reinforced plastic.

6. An engine as defined in claim 5, wherein said valve actuating cam gear is made of a fiber reinforced plastic and integratedly formed in one piece with the outer tubular portion of said valve actuating camshaft.

7. An engine as defined in claim 3, further comprising:

a crankshaft has a crank arm and balance weights and is rotatably supported by said engine body, said valve actuating camshaft is disposed in parallel with said crankshaft, and said valve actuating cam gear and said centrifugal weight are disposed on the side of the second side surface rather than on the crank arm and the balance weight.

8. An engine as defined in claim 1, wherein said mounting means comprises a pivot pin extending from the first side surface of said valve actuating cam gear, through the valve actuating cam gear, and projecting beyond the second side surface.

9. An engine as defined in claim 8, further comprising:

a weight holder fixed to said second side surface by said pivot pin, said governor weight being pivotally supported by said weight holder.

* * * * *